US006431625B1

(12) United States Patent
Copier

(10) Patent No.: US 6,431,625 B1
(45) Date of Patent: Aug. 13, 2002

(54) APPARATUS FOR PICKING UP TWO CONTAINERS PLACED ONE ON TOP OF ANOTHER

(75) Inventor: Carolus Johannes Bernardus Arnoldus Copier, Eindhoven (NL)

(73) Assignee: Smits Intellectual Property N.V., Willemstad (AN)

( * ) Notice: Subject to any disclaimer, the term of this patent is extended or adjusted under 35 U.S.C. 154(b) by 0 days.

(21) Appl. No.: 09/474,742

(22) Filed: Dec. 29, 1999

(30) Foreign Application Priority Data

Jan. 5, 1999 (NL) ..... 1010956

(51) Int. Cl.[7] ..... B66F 9/18

(52) U.S. Cl. ..... 294/81.5; 414/607; 414/620

(58) Field of Search ..... 414/607, 620, 414/623; 294/81.5, 81.51, 67.3, 67.31; 24/287

(56) References Cited

U.S. PATENT DOCUMENTS

| | | | | |
|---|---|---|---|---|
| 4,546,891 A | * | 10/1985 | Lanigan, Sr. et al. | 294/81.54 |
| 4,606,568 A | * | 8/1986 | Karlsson | 414/607 |
| 4,824,318 A | * | 4/1989 | Dones | 414/607 |
| 6,086,316 A | * | 7/2000 | Sundermijer | 414/607 |

FOREIGN PATENT DOCUMENTS

| | | | | |
|---|---|---|---|---|
| EP | 183320 | * | 6/1986 | B66F/9/18 |
| EP | 0 638 512 A1 | | 2/1995 | |
| FR | 1.571.930 | | 6/1969 | |
| JP | 9165200 | * | 6/1997 | B66F/9/18 |
| NL | 9300079 | | 8/1994 | |
| NL | 1004817 | | 6/1998 | |
| WO | WO 97/30928 | | 8/1997 | |

* cited by examiner

*Primary Examiner*—James W. Keenan
(74) *Attorney, Agent, or Firm*—Ladas & Parry

(57) ABSTRACT

The invention relates to a carrying device to be coupled to a forklift truck for picking up two containers placed one on top of another, which are provided near their corner points with coupling pieces. Coupling devices of the carrying device are arranged in pairs, wherein an insert part of a first coupling device can be inserted into a coupling piece present near the upper side of the lower container, and two insert parts disposed one above another of a second coupling device of the pair in question, which is capable of pivoting movement with respect to the frame of the carrying device, can be inserted into a coupling piece of the first container and into a coupling piece present on the bottom side of the upper container, respectively. The second coupling device is pivotally connected with one end to one end of a connecting piece, which is pivotally connected with its other end to the frame of the carrying device, whilst a connecting rod is pivotally provided between the ends of the second coupling device and the frame.

17 Claims, 5 Drawing Sheets

APPARATUS FOR PICKING UP TWO CONTAINERS PLACED ONE ON TOP OF ANOTHER

FIELD AND BACKGROUND

The invention relates to a carrying device to be coupled to a vertically movable support of a forklift truck or the like for picking up two containers placed one on top of another, which are provided near their corner points with coupling pieces, in which openings are present, into which insert parts of coupling means connected to a frame of the carrying device can be inserted, wherein said coupling means are arranged in pairs, in such a manner that an insert part of a first coupling means of each pair of coupling means can be inserted in a first direction into a coupling piece which is provided near the upper side of the lower one of the two containers placed one on top of another, and two insert parts disposed one above another of a second coupling means of the pair in question, which is capable of pivoting movement with respect to the frame of the carrying device, can be inserted into said coupling piece of the first container and into a coupling piece provided on the bottom side of the upper container of the containers placed one on top of another, which coupling piece is positioned near said coupling piece of the first container, in a direction transversely to the direction in which the insert part of the first coupling means is to be inserted into the respective coupling piece.

A carrying device of this kind is known from Dutch patent No. 1004817. The carrying device disclosed therein is satisfactory per se, but a certain movement of the containers with respect to the carrying device in the longitudinal direction of the first coupling means can take place with this carrying device in the position in which the containers are coupled to the carrying device.

SUMMARY

According to the invention, the second coupling means is pivotally connected with one end to one end of a connecting piece, which is pivotally connected with its other end to the frame of the carrying device, and one end of a connecting rod is pivotally connected to the second coupling means between the ends of said second coupling means, wherein the other end of the connecting rod is pivotally connected to the frame of the carrying device, whilst a driving element for pivoting the second coupling means engages said connecting piece.

When using the construction according to the invention, it is possible to obtain a firm clamping engagement between the containers and the frame of the carrying device whilst preventing any movement of the containers along the first coupling means. This is for example important in order to ensure that detection means, which are mounted on the device for detecting whether or not the containers are correctly coupled to the carrying device, will operate correctly when the container is being coupled to the carrying device and transported.

BRIEF DESCRIPTION OF DRAWINGS

The invention will be explained in more detail hereafter by means of an embodiment of the construction according to the invention, which is schematically represented in the accompanying figures.

DETAILED DESCRIPTION

Figure 1:
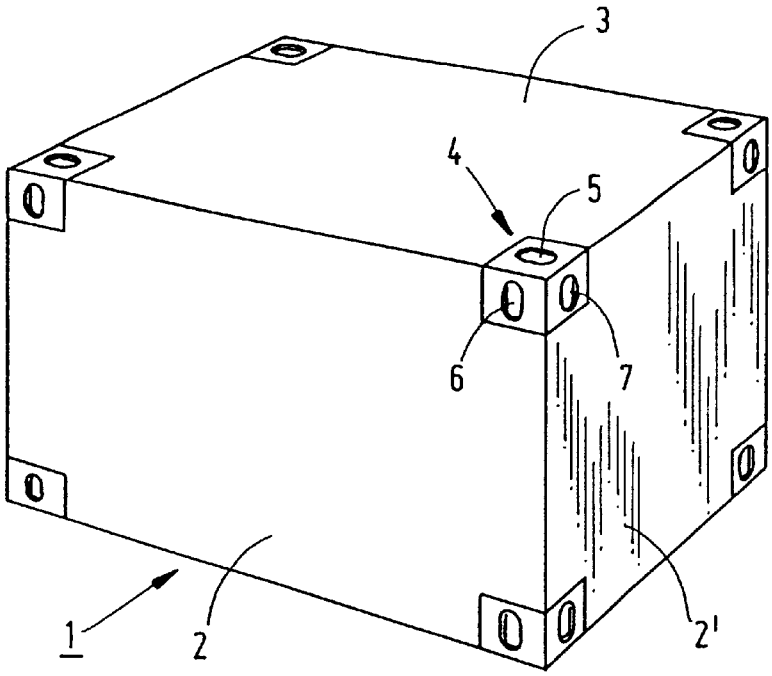
FIG. 1 PRIOR ART
FIG. 1 is a schematic, perspective view of a conventional container.

As is schematically shown in FIG. 1, a conventional parallelopiped container 1 comprises two lateral surfaces 2 extending parallel to each other, two end surfaces 2' extending perpendicularly to said lateral surfaces 2, an upper surface 3 and a lower surface extending parallel thereto (not visible in FIG. 1). Generally, the length of a lateral surface 2 is greater than the width of an end surface 2'. Furthermore, coupling pieces 4 are conventionally provided in the corner points of the container, which coupling pieces are provided in three surfaces extending perpendicularly to each other with openings 5–7 for inserting insert parts of coupling means, which form part of some type of lifting or carrying device by means of which the container in question can be lifted and/or moved, or which forms part of a vehicle and by means of which the container in question can be secured to the vehicle.

Especially empty containers are often moved by means of a so-called forklift truck, to which end a carrying device is coupled to a vertically movable support of the forklift truck, in such a manner that said carrying device is vertically movable in a usual manner by means of a lifting mechanism of the forklift truck or the like. The carrying device is in that case fitted with coupling means, wherein insert parts of said coupling means can be inserted into openings present in the coupling pieces 4 of a container so as to secure the container to the carrying device in question.

Figure 2:
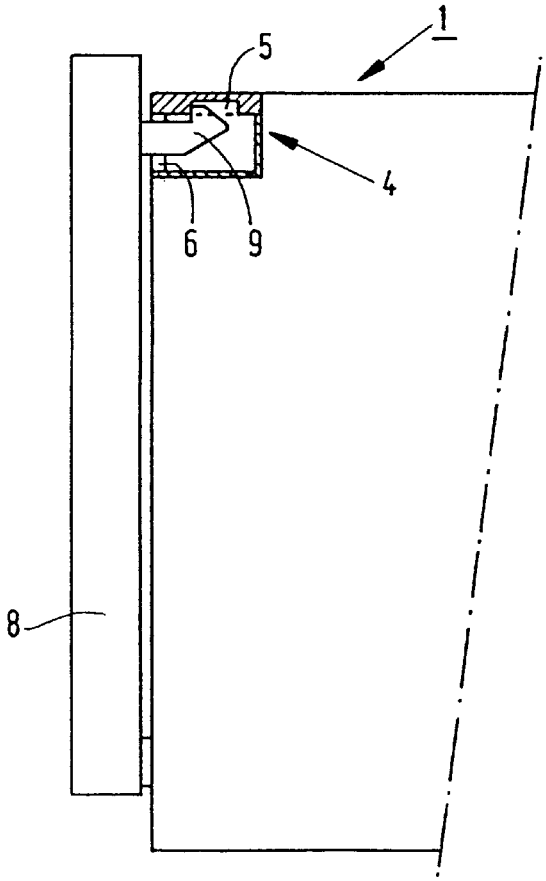
FIG. 2 PRIOR ART
FIG. 2 is a schematic side view of a part of a frame of a carrying device with a container coupled thereto.

Thus, FIG. 2 schematically shows a part of a frame 8 of such a carrying device to be coupled to a forklift truck or the like. In this embodiment as shown in FIG. 2, frame 8 is provided near its upper end with two spaced-apart hook-shaped coupling means 9, which can be inserted in a direction parallel to their longitudinal axes into coupling pieces provided near the upper edge of the container 1 in question, and that conventionally through the openings 6 of coupling pieces 4, which are present on the upper side of said container, near the corner points of the long side 2 of the container. As is shown in FIG. 2, the ends of the insert parts of the hook-shaped coupling means 9 will thereby be positioned in the openings 5 present in the upper surface of the container. Near its bottom side, the container conventionally abuts against frame 8.

As will be apparent from FIG. 2, the construction is thereby such that the coupling means 9 inserted into the coupling pieces 4 do not project from the upper surface of the container, so that it is possible to place a further container on top of said container.

Figure 3:
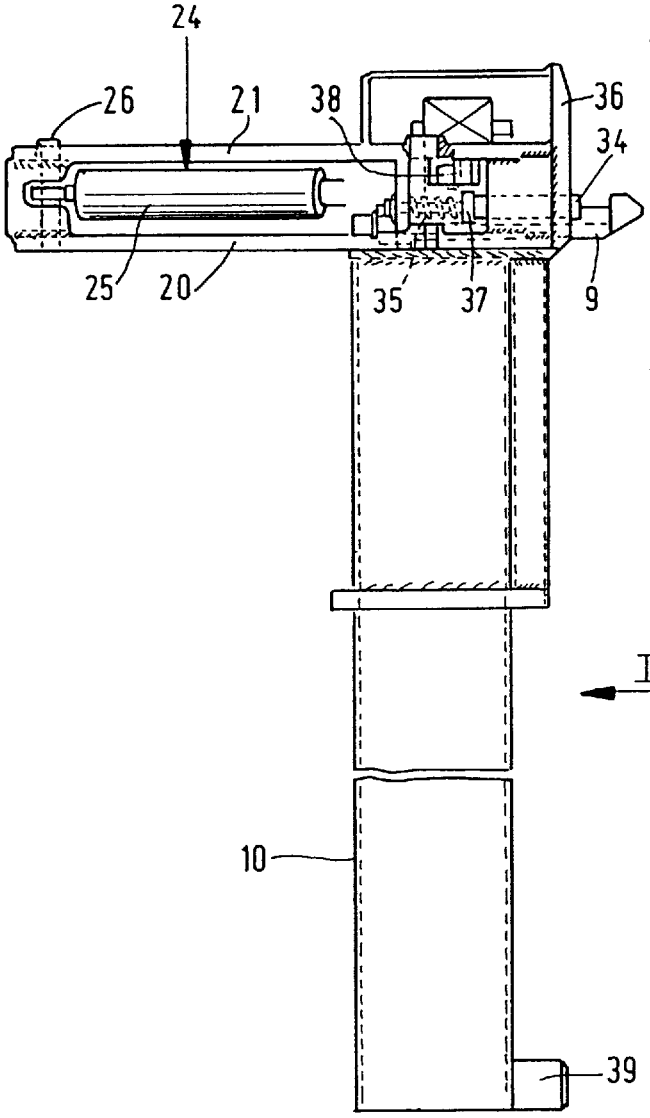
FIG. 3 is a schematic side view of a part of a carrying device fitted with coupling means.
Figure 4:
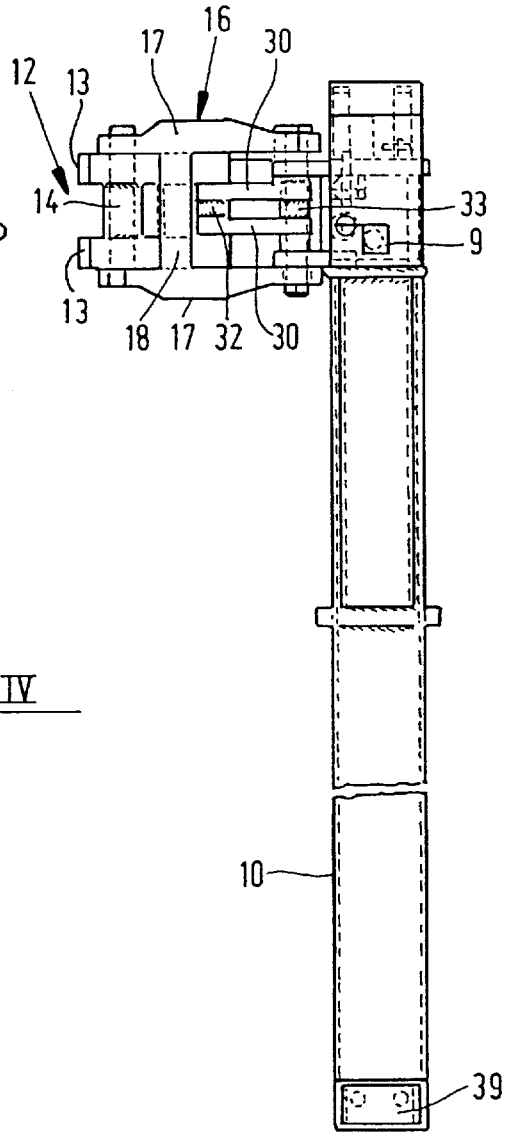
FIG. 4 is a side view of FIG. 3, according to arrow IV in FIG. 3.

The frame 8 to be coupled to a lifting device or the like conventionally comprises two upwardly extending, spaced-apart columns 10, one of which is shown in FIGS. 3 and 4.

Attached to the upper end of each column 10 is a first hook-shaped coupling means 9. Also attached to the upper end of each column 10 is a second coupling means 12, which is provided with two arms 13 positioned one above another, which arms are interconnected by a connecting piece 14.

The free ends of arms 13 form insert parts 15, which can be inserted, in a manner yet to be described in more detail hereafter, into coupling pieces 4 of containers placed one on top of another.

At its end remote from said insert parts 15, said second coupling means 12 is pivotally connected by means of an upwardly or vertically extending pin 15' to one end of a more or less triangular, seen in top plan view, connecting piece 16. Said connecting piece 16 is built up of two plate-shaped part 17 disposed one above another, which are interconnected by a connecting piece 18 extending between said plate-shaped parts. It will be apparent in particular from FIG. 4 that the end of the coupling piece 12 that is pivotally connected to connecting piece 16 by means of pin 15' is positioned between the ends of plate-shaped parts 17 of connecting piece 16.

Connecting piece 16 is furthermore pivotally connected to frame 8, in particular to two vertically spaced-apart horizontal plates 20 and 21 mounted on the upper end of column 10, by means of a pin 19 extending parallel to pin 15'. Connected in a third corner point of said more or less triangular, seen in top plan view, connecting piece 16, by means of a pin 22 extending parallel to pins 15' and 19, is one end of a piston rod 23 forming part of a setting cylinder 24. A cylinder housing 25 of setting cylinder 24 is pivotally connected at its end remote from pin 22, by means of a pin 26 extending parallel to pin 22, to the ends of plates 20 and 21 remote from column 10, whereby, as is apparent in particular from FIG. 3, the end of housing 25 of setting cylinder 24 that is connected by means of pin 26 is positioned between plates 20 and 21.

Connected near the insert parts of the second coupling means, by means of a pin 27 extending parallel to pins 15 and 19, is one end of a coupling rod 28, whilst the other end of said coupling rod 28 is connected to frame 8, in particular to plates 20 and 21, by means of a pin 29 extending parallel to pin 27.

As is apparent in particular from FIG. 4, such a connecting rod is built up of two plate-shaped parts 30 disposed one above another, which are interconnected at one end by means of a bush 32, in which pin 27 is accommodated, whilst the other ends are interconnected by means of a bush 33, in which pin 29 is accommodated.

Figure 5:
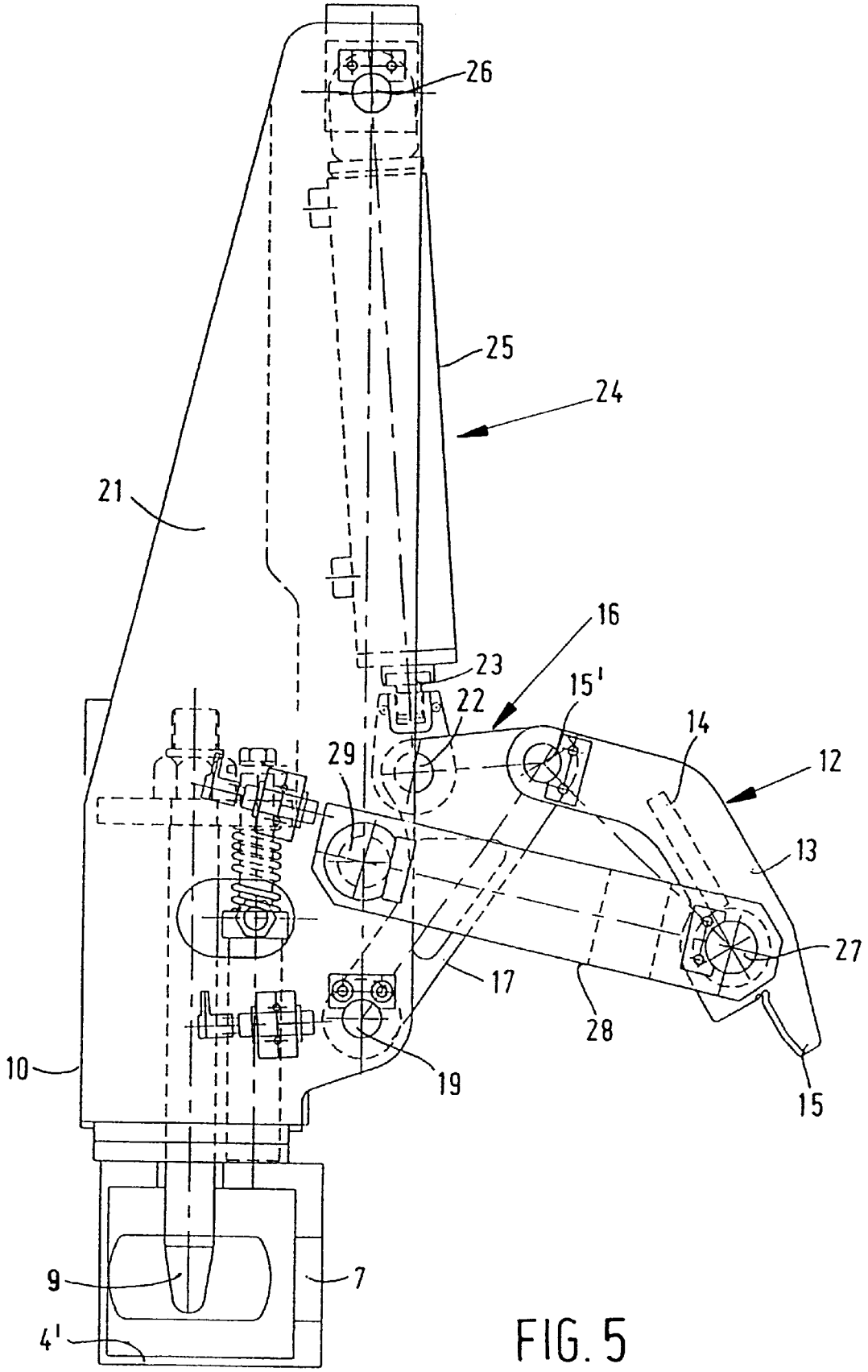
FIGS. 5–7 are top plan views of the coupling means, wherein in particular the second coupling means is shown in various positions thereof, as well as coupling pieces of containers.
Figure 6:
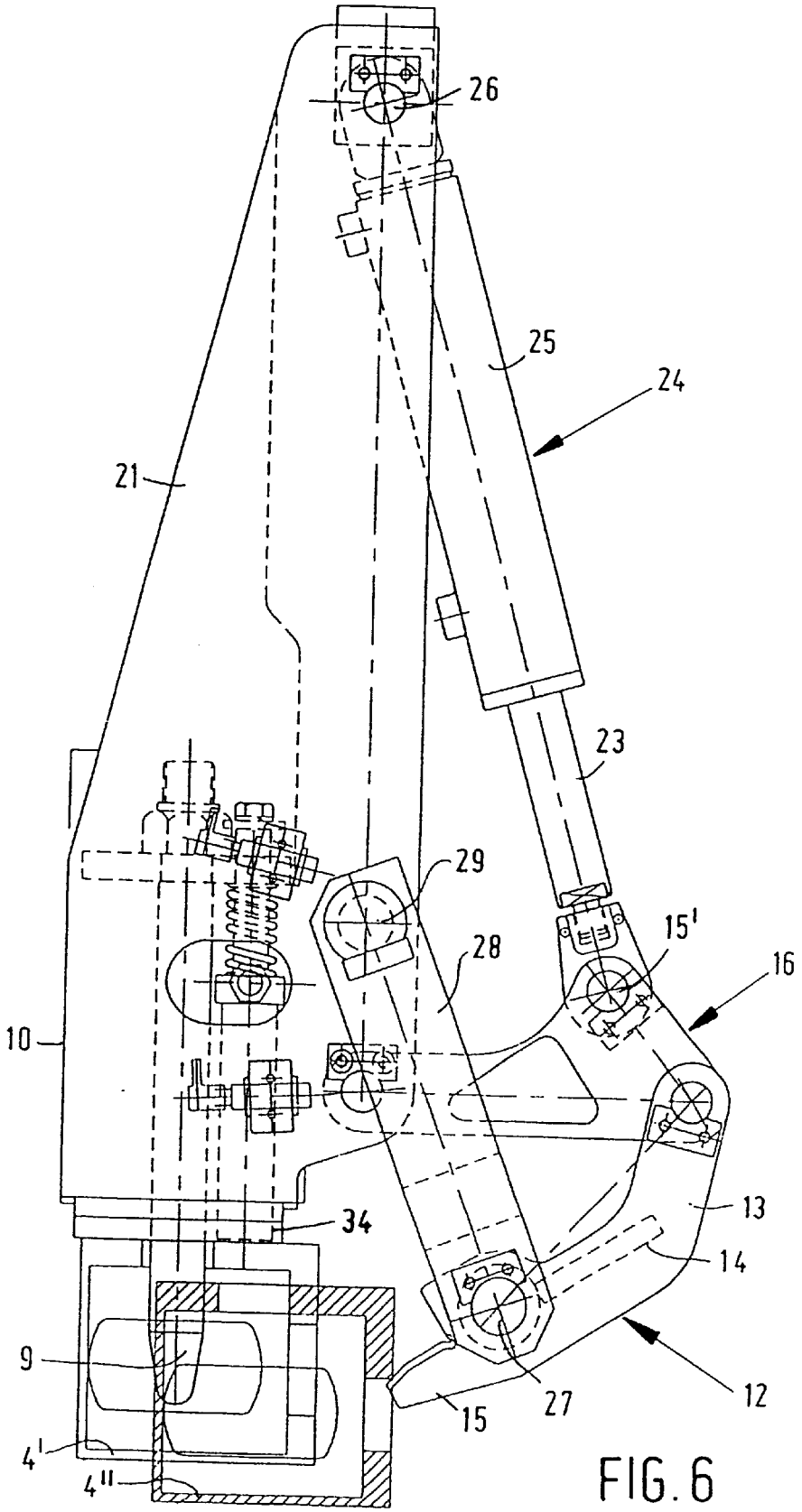
Figure 7:
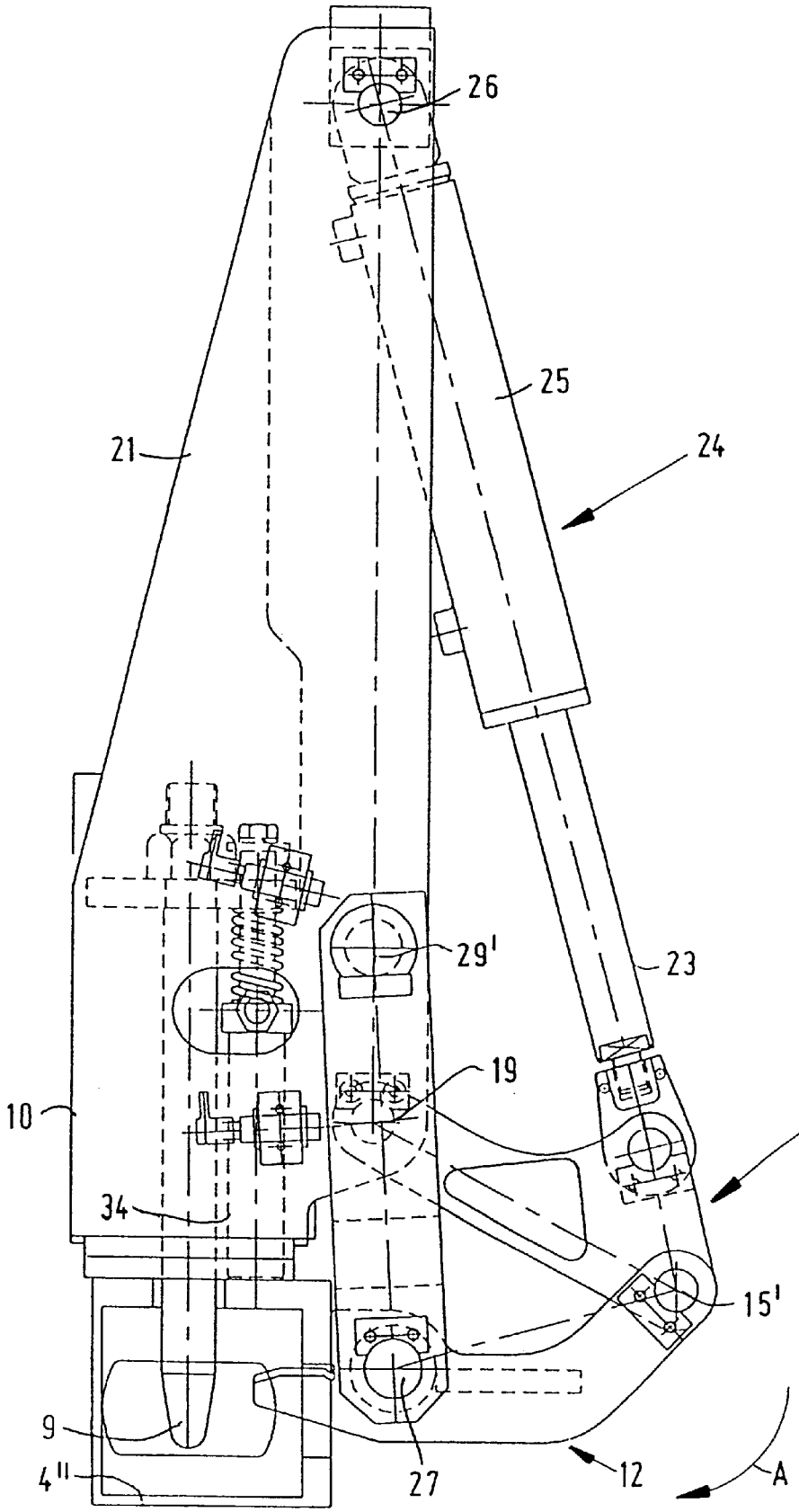

As is apparent from FIGS. 5–7, the central axes of pins 19 and 29 lie in a plane which extends at least substantially parallel to the longitudinal axis of a coupling means 9. Pin 29 is thereby disposed a greater distance away from the side of the frame of the carrying device that faces towards a container to be picked up than pin 19.

Furthermore an at least substantially horizontally extending feeler pin 34 (FIG. 3) is provided near the upper end of column 10, which pin is surrounded along part of its length by a compression spring 35, which attempts to retain the feeler pin 34 in the position which is shown in FIG. 3. As will be apparent from FIG. 3, in this position the free end of feeler pin 34 projects slightly from the supporting surface 36 present at the upper end of column 10, against which a container 1 coupled to the carrying device will abut, as will be explained in more detail hereafter The feeler pin 34, which is likewise accommodated in the space between plates 20 and 21, includes a shoulder 37, which will activate a sensor means 38 upon moving to the left from the illustrated position, seen in FIG. 3.

Furthermore, a buffer 39 is disposed at the bottom end of each column 10, against which a container picked up by means of the carrying device will butt near its bottom side.

Before picking up containers, the coupling means 25 will be pivoted to the completely "open position", as is shown in FIG. 5.

Then the carrying device carried by a forklift truck or the like can be manipulated in such a manner that the free ends of insert parts of the hook-shaped coupling means 9 are inserted into coupling pieces present on the upper side of a container 1, as discussed above.

When two containers placed one on top of another are being picked up, the coupling pieces present near the upper side of the lower container will be positioned near the coupling pieces present on the bottom side of the upper container, whilst said coupling pieces need not always be positioned straight above each other thereby, as is indicated in FIG. 6 for a coupling piece 4' on the upper side of a lower container and a coupling piece 4" on the bottom side of a container placed on top thereof.

After insertion of the coupling means 9 into the coupling pieces 4 of the lower container, the two second coupling means 12 of the carrying device will be pivoted towards each other and in the direction of the coupling pieces 4" on the bottom side of the upper container by means of setting cylinder 24, as is shown in FIGS. 6 and 7.

The upper insert parts 15 of the coupling means 12 will thereby be inserted into openings 7 of coupling pieces 4" of the upper container, which are present on the short sides of the container, whilst the lower insert parts 15 of the second coupling means 12 will be inserted into holes 7 in the respective coupling pieces 4', which are present on the sides of the lower container.

During said pivoting of the second coupling means 12, the upper container will be moved with respect to the lower container if the upper container is not positioned straight above the lower container, and this in such a manner that eventually the coupling pieces 4' and 4" will be positioned straight above each other.

As will be apparent from FIG. 7, once the second coupling means 12 have reached their inwardly pivoted end position, each connecting rod 28 will have moved to a position in which it extends approximately perpendicularly to the boundary surface 2 of the container that faces towards the carrying device. In this position, in which pin 27, about which the coupling means 12 pivots with respect to connecting rod 28, is positioned on the side of connecting piece 16 remote from setting cylinder 24, it is furthermore possible to effect pivoting movement of coupling means 12 about pins 27 in the direction indicated by arrow A by means of setting cylinder 24, as is indicated in FIG. 7, as a result of which coupling pieces 4', 4" will be pressed firmly against the supporting surfaces 36 of carrying frame 8 and be retained in this position. When the containers are thus being pressed against said supporting surfaces 36, the feeler pins 34 disposed near the upper ends of the columns will be depressed and thus activate the sensor means. Said sensor means will then deliver a signal that the two containers are secured to carrying device 8 in the intended manner.

It will be apparent that the disconnecting of the containers from the carrying device can take place in a sequence which is the reverse of the above-described coupling sequence.

What is claimed is:

1. A carrying device to be coupled to a vertically movable support of a forklift truck for picking up two containers placed one on top of another, which are provided with coupling pieces, in which openings are present, into which insert parts of coupling means connected to a frame of the carrying device can be inserted, wherein said coupling means are arranged in pairs, in such a manner that an insert part of first coupling means of each pair of coupling means can be inserted in a first direction into a coupling piece which is provided near an upper side of the lower one of the two containers placed one on top of another, and two insert parts disposed one above another of a second coupling means which is capable of pivoting movement with respect to the frame of the carrying device, can be inserted into said coupling piece and into an other coupling piece, said other coupling piece is positioned near said coupling piece, in a direction transversely to the direction in which the insert part of the first coupling means is to be inserted into said coupling piece, wherein the second coupling means having two ends, said second coupling means being pivotally connected with one said end to a first end of a connecting piece, having said first end and a second end, which is pivotally connected with said second end to the frame of the carrying device, and a one end of a connecting rod, having said on end and an other end, is pivotally connected to the second coupling means between said end of said second coupling means, wherein said other end of the connecting rod is pivotally connected to the frame of the carrying device, whilst a driving element for pivoting the second coupling means engages said connecting piece.

2. A carrying device according to claim 1, wherein a first pivot pin about which the connecting piece can pivot with respect to the frame and a second pivot pin about which the connecting rod can pivot with respect to the frame lie in a plane which extends at least substantially parallel to the direction of insertion of the first coupling means.

3. A carrying device according to claim 2, wherein the first pivot pin about which the connecting piece can pivot with respect to the frame is disposed closer to the side of the carrying device that faces towards the containers to be picked up than the second pivot pin about which the connecting rod can pivot with respect to the frame.

4. A carrying device according to claim 2, wherein a setting cylinder is provided between the frame and the connecting piece, said setting cylinder engages said connecting piece between a connecting point of the second coupling means to said connecting piece and an other connecting point of said connecting piece to the frame.

5. A carrying device according to claim 2, wherein the construction is such that in the position of the second coupling means in which a container is secured to the carrying device, a third pivot pin between the second coupling means and the connecting rod is disposed on the side of the connecting piece that faces away from a setting cylinder by means of which said connecting piece call be pivoted.

6. A carrying device according to claim 2, wherein said carrying device is fitted with a feeler pin, in such a manner that said feeler pin will be moved when a container is being secured to the frame.

7. A carrying device according to claim 1, wherein a first pivot pin about which the connecting piece can pivot with respect to the frame is disposed closer to the side of the carrying device that faces towards the containers to be picked up than a second pivot pin about which the connecting rod can pivot with respect to the fame.

8. A carrying device according to claim 7, wherein a setting cylinder is provided between the frame and the connecting piece, said setting cylinder engages said connecting piece between a connecting point of the second coupling means to said connecting piece and an other connecting point of said connecting piece to the frame.

9. A carrying device according to claim 7, wherein the construction is such that in the position of the second coupling means in which a container is secured to the carrying device, a third pivot pin between the second coupling means and the connecting rod is disposed on the side of the connecting piece that faces away from a setting cylinder by means of which said connecting piece can be pivoted.

10. A carrying device according to claim 7, wherein said carrying device is fitted with a feeler pin, in such a manner that said feeler pin will be moved when a container is being secured to the frame.

11. A carrying device according to claim 1, wherein a setting cylinder is provided between the frame and the connecting piece, said setting cylinder engages said connecting piece between a connecting point of the second coupling means to said connecting piece and an other connecting point of said connecting piece to the frame.

12. A carrying device according to claim 11, wherein the construction is such that in the position of the second coupling means in which a container is secured to the carrying device, a third pivot pin between the second coupling means and the connecting rod is disposed on the side of the connecting piece that faces away from the setting cylinder by means of which said connecting piece can be pivoted.

13. A carrying device according to claim 11, wherein said carrying device is fitted with a feeler pin, in such a manner that said feeler pin will be moved when a container is being secured to the frame.

14. A carrying device according to claim 1, wherein the construction is such that in the position of the second coupling means in which a container is secured to the carrying device, a third pivot pin between the second coupling means and the connecting rod is disposed on the side of the connecting piece that faces away from a setting cylinder by means of which said connecting piece can be pivoted.

15. A carrying device according to claim 14, wherein said carrying device is fitted with a feeler pin, in such a manner that said feeler pin will be moved when a container is being secured to the frame.

16. A carrying device according to claim 1, wherein said carrying device is fitted with a feeler pin, in such a manner that said feeler pin will be moved when a container is being secured to the frame.

17. A carrying device to be coupled to a vertically movable support of a lifting means for picking up two containers placed one on top of another, which are provided with coupling pieces, in which openings are present, into which insert parts of coupling means connected to a frame of the carrying device can be inserted, wherein said coupling means are arranged in pairs, in such a manner that an insert part of a first coupling means of each pair of coupling means can be inserted in a first direction into a coupling piece and two insert parts disposed one above another of a second coupling means which is capable of pivoting movement with respect to the frame of the carrying device, can be inserted into said coupling piece and into an other coupling piece, said other coupling piece is positioned near said coupling piece, in a direction transversely to the direction in which the insert part of the first coupling means is to be inserted into said coupling piece, wherein the second coupling means having two ends, said second coupling means being pivotally connected with one said end to a first end of a connecting piece, having said first end and a second end, which is pivotally connected with said second end to the frame of the carrying device, and a one end of a connecting rod, having said one end and an other end, is pivotally connected to the second coupling means between said ends of said second coupling means, wherein said other end of the connecting rod is pivotally connected to the frame of the carrying device, whilst a driving element for pivoting the second coupling means engages said connecting piece.

* * * * *